US010923075B2

(12) United States Patent
Wang et al.

(10) Patent No.: US 10,923,075 B2
(45) Date of Patent: Feb. 16, 2021

(54) DISPLAY METHOD, DISPLAY DEVICE, ELECTRONIC DEVICE AND COMPUTER READABLE STORAGE MEDIUM

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Xiurong Wang, Beijing (CN); Lingyun Shi, Beijing (CN); Yafei Li, Beijing (CN); Wenhao Liu, Beijing (CN); Tao Yang, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/533,213

(22) Filed: Aug. 6, 2019

(65) Prior Publication Data

US 2020/0286445 A1 Sep. 10, 2020

(30) Foreign Application Priority Data

Mar. 4, 2019 (CN) ..... 2019 1 0160788

(51) Int. Cl.
*G09G 5/02* (2006.01)

(52) U.S. Cl.
CPC ..... *G09G 5/026* (2013.01); *G09G 2310/0235* (2013.01); *G09G 2340/12* (2013.01); *G09G 2360/18* (2013.01)

(58) Field of Classification Search
None
See application file for complete search history.

(56) References Cited

U.S. PATENT DOCUMENTS 7,825,921 B2 * 11/2010 Han ..... G09G 5/006 345/213
2010/0079489 A1 * 4/2010 Cheng ..... G11B 27/034 345/629

* cited by examiner

*Primary Examiner* — Nicholas R Wilson
(74) *Attorney, Agent, or Firm* — Kinney & Lange, P.A.

(57) ABSTRACT

A method of displaying an image, a display device, an electronic device and a computer readable storage medium are disclosed. The method may comprise: acquiring an image to be displayed, the image comprising a plurality of layers; superimposing first image information of pixels in each of the plurality of layers, so as to obtain second image information of pixels in an overlaid layer image; arranging the second image information based on a plurality of colors, so as to obtain third image information comprising a plurality of portions; and displaying each portion having the same color sequentially in a preset order of the plurality of colors.

12 Claims, 9 Drawing Sheets

DISPLAY METHOD, DISPLAY DEVICE, ELECTRONIC DEVICE AND COMPUTER READABLE STORAGE MEDIUM

CROSS-REFERENCE TO RELATED APPLICATION(S)

This application claims the priority of Chinese Patent Application No. 201910160788.5 filed on Mar. 4, 2019, the entire contents of which are hereby incorporated by reference.

TECHNICAL FIELD

Embodiments of the present disclosure relates to the field of display, and in particular to a method of displaying an image, a display device, an electronic device and a computer readable storage medium.

BACKGROUND

Field sequential displaying is to display RGB components of the frame picture on a screen sequentially, and synthesize the RGB components to a complete frame picture by using the visual inertia of human eyes, so as to maintain the visual perception. Therefore, a field sequential display device does not need a color film for filtering, but switches R, G and B backlights in synchronization with the RGB components.

SUMMARY

Embodiments of the present disclosure provide a method of displaying an image, a display device, an electronic device and a computer readable storage medium.

According to an aspect of embodiments of the disclosure, there is provided a method of displaying an image, comprising:

acquiring an image to be displayed, the image comprising a plurality of layers;

superimposing first image information of pixels in each of the plurality of layers, so as to obtain second image information of pixels in an overlaid layer image, wherein the first image information comprises a plurality of color information and transparency information, and the second image information comprises a superposition result of the plurality of color information;

arranging the second image information based on a plurality of colors, so as to obtain third image information comprising a plurality of portions, each of the plurality of portions having the same color; and displaying each of the plurality of portions sequentially in a preset order of the plurality of colors.

For example, the plurality of colors comprise a Red(R) color, a Green(G) color, and a Blue(B) color; and wherein arranging the second image information based on the plurality of colors so as to obtain the third image information comprises:

determining a position of each element of the second image information in the third image information, wherein the overlaid layer image comprises n pixels, and each of the n pixels comprises three sub-pixels, the $x^{th}$ R sub-pixel Rx being positioned in the $((x-1)\%3+1)^{th}$ sub-pixel of the $(\text{floor}((x-1)/3)+1)^{th}$ pixel in the third image information, the $x^{th}$ G sub-pixel Gx being positioned in the $((x-1)\%3+1)^{th}$ sub-pixel of the $(n/3+\text{floor}((x-1)/3)+1)^{th}$ pixel in the third image information, and the $x^{th}$ B sub-pixel Bx being positioned in the $((x-1)\%3+1)^{th}$ sub-pixel of the $(2n/3+\text{floor}((x-1)/3)+1)^{th}$ pixel in the third image information, where "%" is a modulus operator, "floor" is a down rounding operator, n is an integer greater than 3, and x=1 . . . n.

For another example, each of the plurality of layers is arranged in an overlaid manner, and wherein superimposing the first image information of the pixels in each of the plurality of layers, so as to obtain the second image information of pixels in an overlaid layer image comprises:

superimposing the color information of the pixels in each layer according to the transparency information of the pixels and an ordering of each layer along an overlapping direction of the plurality of layers, so as to obtain the second image information of pixels in the overlaid layer image.

For another example, the first image information further comprises position information and texture information of the layer, and wherein superimposing the first image information of the pixels in each of the plurality of layers, so as to obtain the second image information of pixels in an overlaid layer image comprises:

superimposing the texture information of each layer according to the position information of each layer and the transparency information of the pixels in each layer, so as to obtain the second image information of pixels in the overlaid layer image.

For another example, the method further comprises, prior to displaying each of the plurality of portions sequentially:

synthesizing the third image information, so as to obtain a synthesized layer information; and storing the synthesized layer information in a frame buffer, and wherein displaying each of the plurality of portions sequentially further comprises: reading and displaying each portion having the same color among the synthesized layer information from the frame buffer sequentially in the preset order of the plurality of colors.

For another example, synthesizing the third image information so as to obtain the synthesized layer information comprises:

synthesizing the third image information by using a Mobile Display Processor MDP or a Graph Process Unit GPU, so as to obtain the synthesized layer information.

For another example, displaying each of the plurality of portions sequentially further comprises:

parsing each portion having the same color among the synthesized layer information sequentially, and outputting a parsed portion for displaying.

According to another aspect of the present disclosure, there is provided a display device, comprising:

an acquiring module, configured to acquire an image to be displayed, the image comprising a plurality of layers;

a superimposing module, configured to superimpose first image information of pixels in each of the plurality of layers, so as to obtain second image information of pixels in an overlaid layer image, wherein the first image information comprises a plurality of color information and transparency information, and the second image information comprises a superposition result of the plurality of color information;

an arranging module, configured to arrange the second image information based on a plurality of colors, so as to obtain third image information comprising a plurality of portions, each of the plurality of portions having the same color; and a displaying module, configured to display each of the plurality of portions sequentially.

According to yet another aspect of the present disclosure, there is provided a display device, comprising:

one or more processors; and a memory, configured to store one or more programs, wherein the one or more processors are configured to execute the one or more programs, so as to implement the method in accordance with the above embodiments of the disclosure.

For example, the plurality of colors comprise a Red(R) color, a Green(G) color, and a Blue(B) color; and the one or more processors are further configured to determine a position of each element of the second image information in the third image information, wherein the overlaid layer image comprises n pixels, and each of the n pixels comprises three sub-pixels, the $x^{th}$ R sub-pixel Rx being positioned in the $((x-1)\%3+1)^{th}$ sub-pixel of the $(\text{floor}((x-1)/3)+1)^{th}$ pixel in the third image information, the $x^{th}$ G sub-pixel Gx being positioned in the $((x-1)\%3+1)^{th}$ sub-pixel of the $(n/3+\text{floor}((x-1)/3)+1)^{th}$ pixel in the third image information, and the $x^{th}$ B sub-pixel Bx being positioned in the $((x-1)\%3+1)^{th}$ sub-pixel of the $(2n/3+\text{floor}((x-1)/3)+1)^{th}$ pixel in the third image information, where "%" is a modulus operator, "floor" is a down rounding operator, n is an integer greater than 3, and x=1 . . . n.

For another example, the display device further comprises a displaying unit, and wherein the one or more processors are further configured to:

synthesize the third image information, so as to obtain a synthesized layer information;

store the synthesized layer information in a frame buffer; and read the portion having the same color among the synthesized layer information from the frame buffer sequentially in the preset order of the plurality of colors, and send the read portion to the displaying unit, wherein the displaying unit is configured to receive and display the portion having the same color.

For another example, the one or more processors are further configured to:

synthesize the third image information by using a Mobile Display Processor MDP or a Graph Process Unit GPU, so as to obtain the synthesized layer information.

For another example, the displaying unit further comprises:

a driving IC, configured to parse each portion having the same color among the synthesized layer information sequentially for displaying.

According to another aspect of the present disclosure, there is provided an electronic device comprising the display device in accordance with the above embodiments of the present disclosure.

According to another aspect of the present disclosure, there is provided a computer readable storage medium having instructions stored thereon which, when executed by a processor, implement the method in accordance with the above embodiments of the present disclosure.

BRIEF DESCRIPTION OF THE DRAWINGS

In order to illustrate the technical solutions of the embodiments of the present disclosure more clearly, drawings used in the description of the embodiments will be briefly described below. Obviously, the drawings in the following description are only some of the embodiments of the present disclosure, and those skilled in the art can obtain other drawings according to these drawings with no effort.

DETAILED DESCRIPTION

In order to enable a better understanding of the technical objectives, features and advantages of the present disclosure, the embodiments of the present disclosure will be further described in detail below with reference to the drawings and specific implementations.

In a display panel, color display can be realized by setting sub-pixels and color films. The color film blocks about 70% of a backlight, which is the main reason for low transmittance. The low transmittance may cause an increasing power consumption for a normal display screen. The field sequential display panel uses RGB backlights, and may realize the color display by lighting the R, G and B backlights periodically, without setting sub-pixels and color films.

In order to realize the field sequence display, it is necessary to receive the R, G, and B component data sent from a main board of an electronic device sequentially during one frame period, and switch illumination units disposed on the rear of the electronic device synchronously, so as to illuminate in the order of the three component data.

Figure 1:
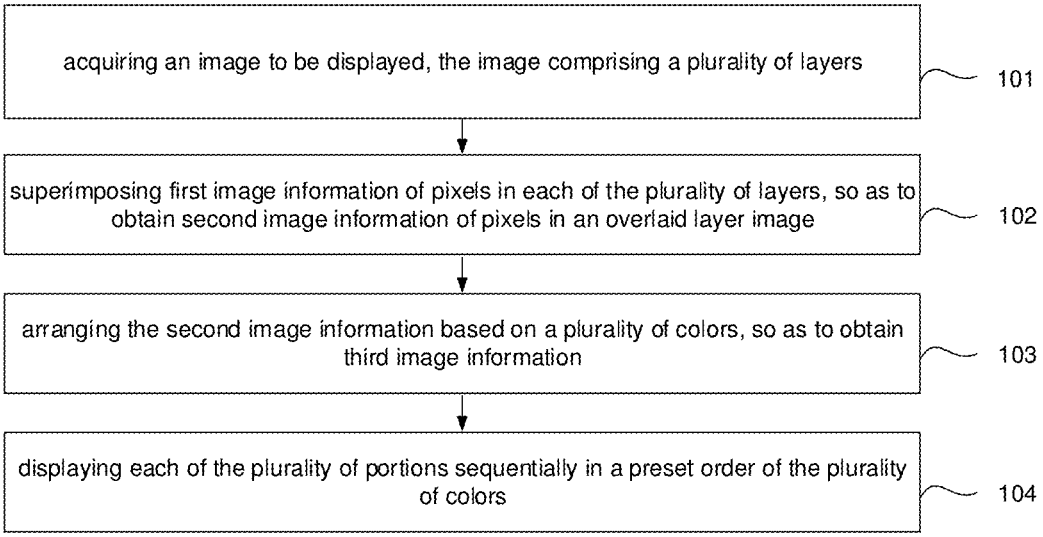
FIG. 1 shows a flow chart of a display method according to an embodiment of the present disclosure.

The embodiments of the present disclosure provide a method of displaying an image, which can be applied to an electronic device. Referring to FIG. 1, the method may include the following steps.

At step 101, an image to be displayed is acquired, wherein the image may comprise a plurality of layers.

Figure 2:
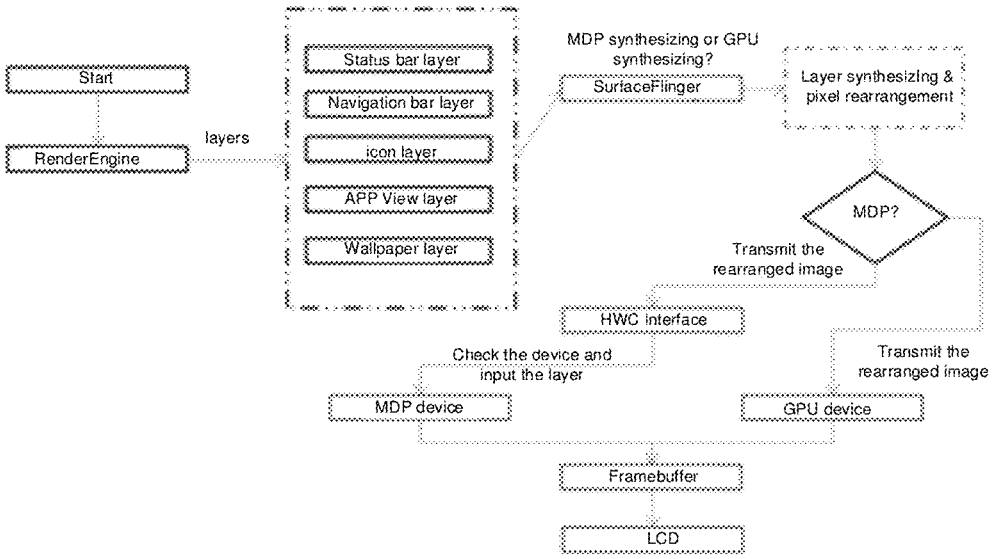
FIG. 2 shows a schematic diagram illustrating the display method according to an embodiment of the present disclosure.

In practical applications, each of the plurality of layers can be drawn by an operating system (such as, Android, IOS, etc.) of the electronic device. Referring to FIG. 2, for example, the plurality of layers may include a status bar and a navigation bar. If the current interface is a desktop, the plurality of layers may further comprise a wallpaper layer and an icon layer. If the current interface is an APP interface, the plurality of layers may further comprise respective View layers included in the APP.

Next, in step 102, first image information of pixels in each of the plurality of layers are superimposed, so as to obtain second image information of pixels in an overlaid layer image, wherein the first image information comprises a plurality of color information and transparency information, and the second image information comprises a superposition result of the plurality of color information.

For example, firstly, the plurality of layers may be generated and rendered separately, so as to obtain the first image information of the pixels in each layer. Among them, the plurality of layers can refer to one layer or more than two layers. For example, by calling the RenderEngine class of the system framework layer, each of the plurality of layers is GPU rendered and stored in the respective buffers, thereby obtaining the first image information of the pixels in each layer (cache Information of each layer). Then, the first image information of the pixels in each layer is submitted to SurfaceFlinger.

In one example, the first image information may include RGBA data of the pixels in each layer, where R is a first color information, G is a second color information, B is a third color information, and A is a transparency information.

There are various ways to superimposing first image information of pixels in each of the plurality of layers. For example, a central processor CPU may be utilized to superimpose first image information of pixels in each layer, so as to obtain the second image information of the pixels in the overlaid layer image. Alternatively, an OpenGLes rendering program may be utilized to superimpose the first image information of pixels in each layer, so as to obtain the second image information of the pixels in the overlaid layer image. The following embodiments will make a detailed description on specific implementations of the superposition.

The second image information may include the first color information, the second color information, and the third color information of each pixel in the overlaid layer image. Assuming that the number of pixels in the overlaid layer image is n, the second image information may be a collection of {r1g1b1, r2g2b2, r3g3b3, . . . , rngnbn}, where n is an integer greater than 1.

Those skilled in the art should understand that the plurality of colors are not limited to the above three colors, and in the actual application, it may be two colors, four colors, and the like, which is not limited in this embodiment. This embodiment is described by taking a plurality of colors being three colors of RGB as an example.

In step 103, the second image information is arranged based on a plurality of colors, so as to obtain third image information comprising a plurality of portions, each of the plurality of portions having the same color. The third image information may be in a form of a collection.

For example, in OpenGL's shading language, due to the parallel characteristic, any pixel cannot access the results produced by other pixels. Therefore, it is possible to specify the position of each of the R, G, and B values of each pixel in the overlaid layer, in the third image information. Elements having the same color among the second image information may be grouped into one portion. There may be various rules for arranging the elements in each portion having the same color. For example, the elements with the first color, the second color, and the third color may be arranged in the order of scanning pixels from the upper left pixel to the lower right pixel of the field sequential display screen, so as to generate a first portion corresponding to the first color, a second portion corresponding to the second color and a third portion corresponding to the third color, wherein the first portion, the second portion and the third portion constitute the third image information.

It can be understood by those skilled in the art that the number of portions included in the third image information may be the same as the number of the plurality of colors, that is, the third image information may include a plurality of portions corresponding to the plurality of colors. The number of elements in each portion can be the same as the total number of pixels in the overlaid layer image.

Figure 3A:
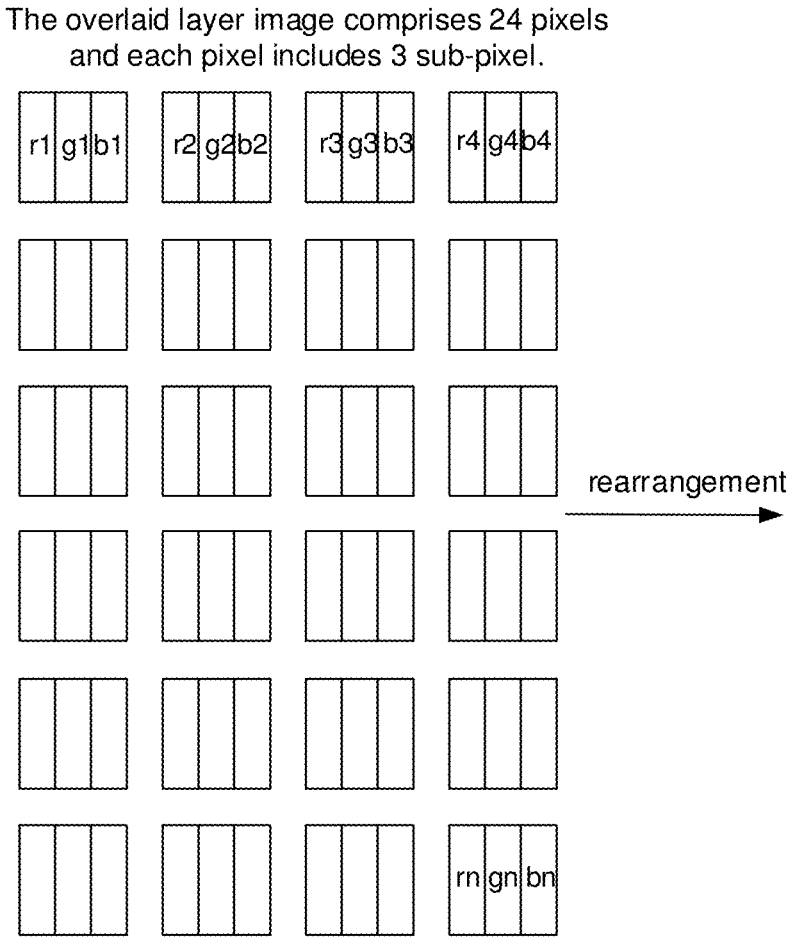
FIGS. 3A, 3B and 3C show schematic diagrams illustrating a step of arranging second image information of pixels in an overlaid layer image according to an embodiment of the present disclosure.
Figure 3B:
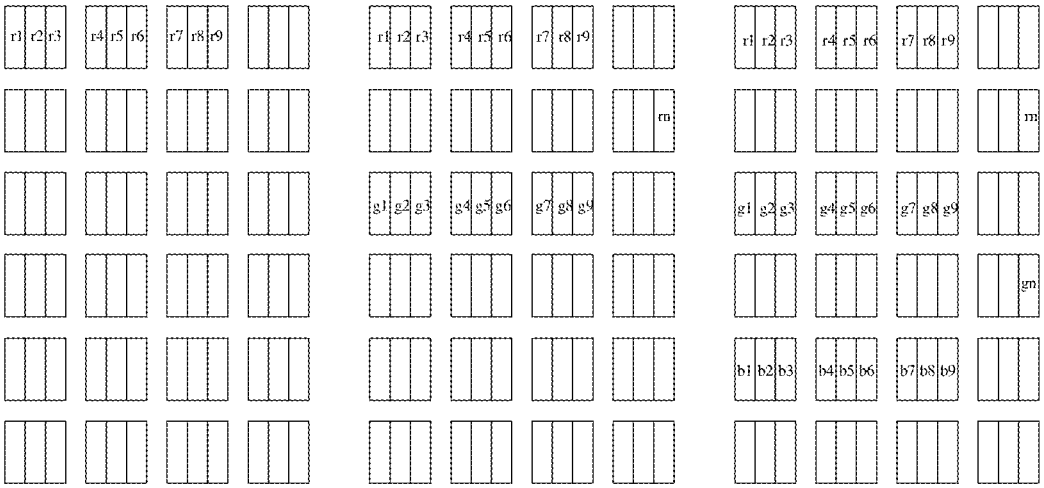
Figure 3C:
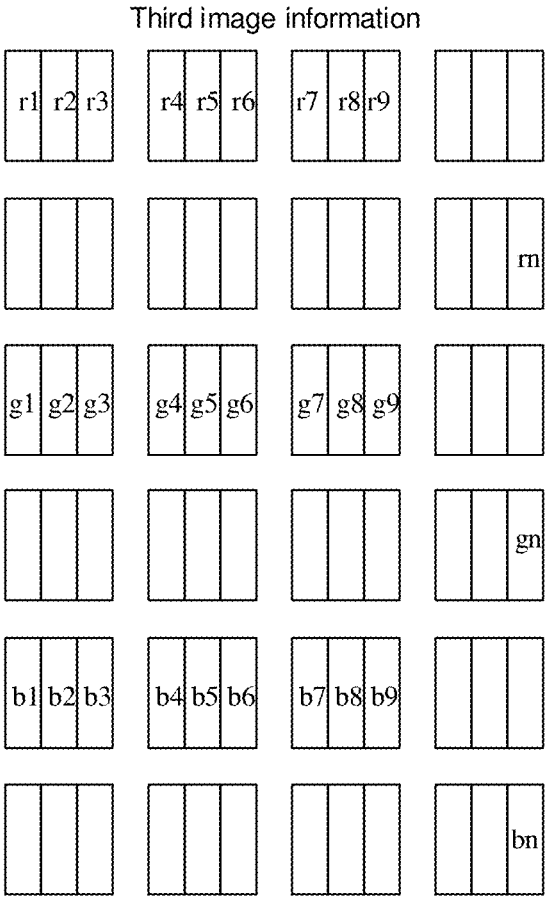

As shown in FIG. 3A to FIG. 3C, the second image information of the pixels in the overlaid layer image is {r1g1b1, r2g2b2, r3g3b3, . . . , rngnbn}. Three portions corresponding to the three colors may be generated after the second image information being classified and arranged based on colors. For example, the first portion corresponding to the first color is r1r2r3r4r5r6 . . . rn, the second portion corresponding to the second color is g1g2g3g4g5g6 . . . gn, and the third portion corresponding to the third color is b1b2b3b4b5b6 . . . bn, thereby obtaining the third image information {r1r2r3r4r5r6 . . . rn, g1g2g3g4g5g6 . . . gn, b1b2b3b4b5b6 . . . bn}.

The position of each element of the second image information in the third image information can be determined as follows. Referring to FIG. 3A to FIG. 3C, assuming that the overlaid layer image comprises n pixels, and each of the n pixels comprises three sub-pixels, the $x^{th}$ R sub-pixel Rx being positioned in the $((x-1)\%3+1)^{th}$ sub-pixel of the $(\text{floor}((x-1)/3)+1)^{th}$ pixel in the third image information, the $x^{th}$ G sub-pixel Gx being positioned in the $((x-1)\%3+1)^{th}$ sub-pixel of the $(n/3+\text{floor}((x-1)/3)+1)^{th}$ pixel in the third image information, and the $x^{th}$ B sub-pixel Bx being positioned in the $((x-1)\%3+1)^{th}$ sub-pixel of the $(2n/3+\text{floor}((x-1)/3)+1)^{th}$ pixel in the third image information. The third image information having a plurality of portions may be obtained by arranging the plurality of color information in such manner. Among others, "%" is a modulus operator, "floor" is a down rounding operator, n is an integer greater than 3, and x=1 . . . n.

Next, at step 104, each of the plurality of portions is sequentially displayed in a preset order of the plurality of colors.

For example, the plurality of portions corresponding to the plurality of the colors among the third image information may be sequentially displayed in a preset order of the plurality of colors.

The preset order of the plurality of colors may be an arbitrary arrangement order among the first color R, the second color G, and the third color B. For example, the plurality of portions corresponding to the plurality of colors in the third image information may be sequentially displayed in the order of RGB, that is, the first portion corresponding to the first color, the second portion corresponding to the second color, and the third portion corresponding to the three color are displayed sequentially.

For example, after step 103, the third image information may also be synthesized to obtain synthesized layer information.

The synthesized layer information may still comprise a plurality of synthesized portions, and the number of synthesized portions may be the same as the number of colors, that is, the synthesized layer information includes the plurality of synthesized portions corresponding to the plurality of colors. The number of elements in each synthesized portion can be the same as the number of pixels in the overlaid layer image.

For example, the third image information is synthesized by using a Mobile Display Processor MDP or a Graph Process Unit GPU, so as to obtain the synthesized layer information. In one example, the method may further comprise: parsing each synthesized portion having the same color among the synthesized layer information sequentially, and outputting a parsed portion for displaying, via a driving IC.

Taking the plurality of colors being three colors as an example, the synthesized layer information may still comprise three synthesized portions, each synthesized portion having the same color, and three synthesized portions corresponding to three different colors. For example, the first synthesized portion corresponding to the first color is r1r2r3r4r5r6 . . . rn, the second synthesized portion corresponding to the second color is g1g2g3g4g5g6 . . . gn, and the third synthesized portion corresponding to the third color is b1b2b3b4b5b6 . . . bn.

Figure 7:
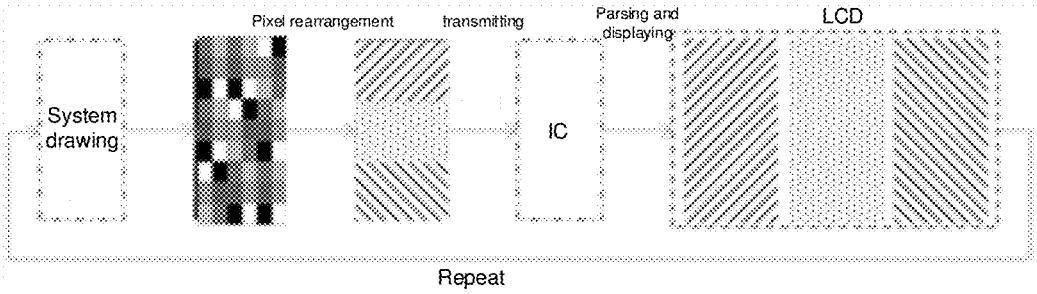
FIG. 7 shows a schematic diagram illustrating sequential steps of rearranging, outputting, and displaying an overlaid layer image according to an embodiment of the present disclosure.

Referring to FIG. 7, the synthesized layer information can be transmitted to the driving IC at a frame refreshing rate. Corresponding to the three colors, the driving IC parses and outputs each synthesized portion in the synthesized layer information sequentially at a triple of the frame refreshing rate, so as to display.

For example, the plurality of synthesized portions corresponding to the plurality of colors among the synthesized layer information may be transmitted to the driving IC at the frame refreshing rate in the order of RGB. The driving IC may parse and output the first synthesized portion corresponding to the first color r1r2r3r4r5r5r6 . . . rn, the second synthesized portion corresponding to the second color g1 g2g3g4g5g6 . . . gn, and the third synthesized portion corresponding to the third color b1b2b3b4b5b6 . . . bn sequentially, at a triple of the frame refreshing rate in the order of RGB, for displaying by the display panel.

For example, the storage space of the RAM can be set such that the driving IC may only parse ⅓ of the data at a time, that is, the portion corresponding to one single color, and read all the values of one color at a time.

After being parsed by the driving IC, the read information is outputted at a triple of the frame refreshing rate. Among others, a first ⅓ of the data is taken for display, and the backlight is set to the first color R; then, another ⅓ of the data is taken from the previous buffer position for display, and the backlight is set to the second color G; a last ⅓ of the data is taken for display, and the backlight is set to the third color B. Since the visions may stay in the human eye for a while to synthesize a complete picture, the visual effect in the human eye does not change, and the system transmission bandwidth does not change either.

Those skilled in the art can understand that the synthesized layer information received by the driving IC can be understood as a byte string, wherein the first ⅓ of the byte string is arranged as the first synthesized portion corresponding to the first color r1r2r3r4r5r6 . . . rn, and then the another ⅓ of the byte string is arranged as the second synthesized portion corresponding to the second color g1g2g3g4g5g6 . . . gn, and the last ⅓ of the byte string is arranged as the third synthesized portion corresponding to the third color b1b2b3b4b5b6 . . . bn.

Figure 4:
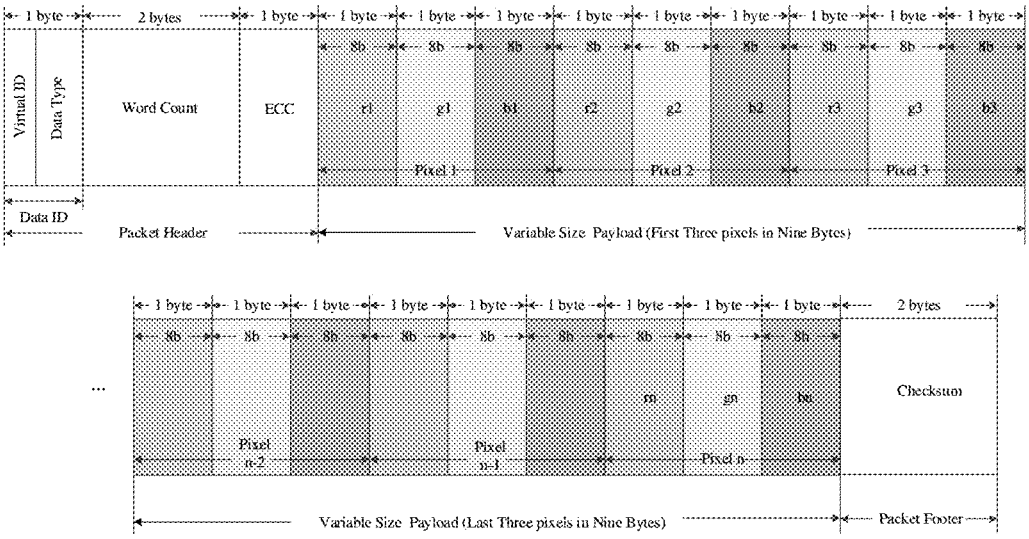
FIG. 4 shows a schematic diagram illustrating an arrangement of data outputted to a driving IC.

FIG. 4 shows a schematic diagram illustrating an arrangement of data outputted to a driving IC. When performing IC parsing of the field sequential display, it is necessary to receive all of the RGB data of pixels in the full screen r1g1b1r2g2b2r3g3b3 . . . before displaying.

Figure 5:
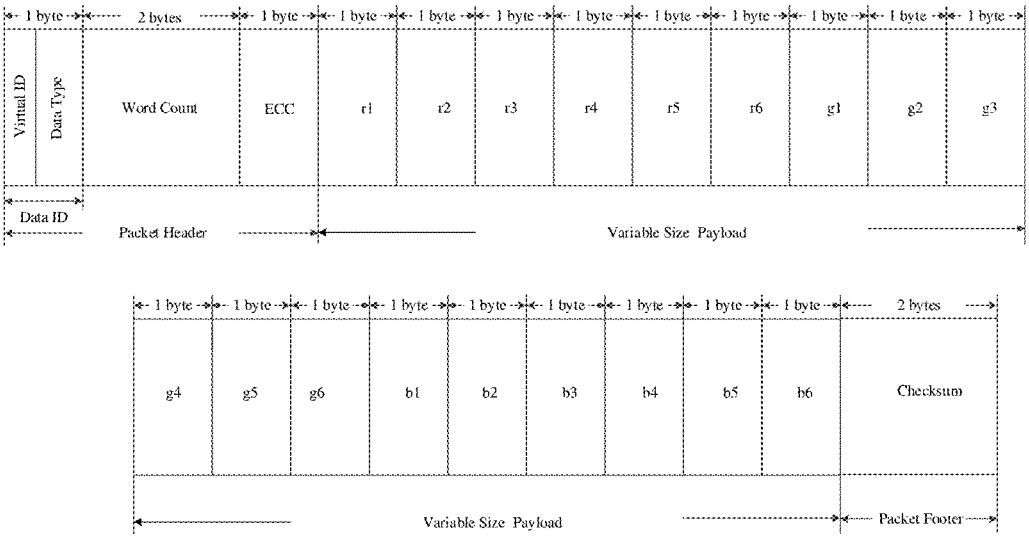
FIG. 5 shows a schematic diagram illustrating an arrangement of data outputted to the driving IC in a field sequential display according to an embodiment of the present disclosure.

FIG. 5 shows a schematic diagram illustrating an arrangement of data outputted to the driving IC in a field sequential display according to an embodiment of the present disclosure. Taking 6 pixels as an example, after arranging the second image information of the pixels in the overlaid layer image, it is only necessary to output one synthesized portion of the synthesized layer information each time. Thus, when parsing by the driving IC, it is only necessary to store ⅓ of the data volume of the normal display screen, which enables parsing the full-screen data information corresponding to the monochrome. Therefore, according to the embodiment of the present disclosure, the field sequential display driving IC may parse the rearranged data, and only ⅓ of the RAM storage space is required to complete the monochrome full-screen data parsing, which can reduce the configuration requirement for the storage space.

According to the display method of the embodiments, by superimposing the first image information of pixels in the plurality of layers and rearranging the second image information of the pixels in the overlaid layer image, the third image information including the plurality of portions may be obtained. By displaying the portion having the same color among the synthesized layer information sequentially, it is possible to perform the field sequential display correctly.

In an example, each of the plurality of layers is arranged in an overlaid manner. The step 102 in the above embodiment may further include: superimposing the color information of the pixels in each layer according to the transparency information of the pixels and an ordering of each layer along an overlapping direction of the plurality of layers, so as to obtain the second image information of pixels in the overlaid layer image.

The overlapping direction may be an outgoing direction of the display of the electronic device.

For example, the plurality of layers may include m layers. The order of the m layers in the overlapping direction is 1, 2 . . . m. The first image information of the pixels in the m layers is R1G1B1A1, R2G2B2A2, . . . , RmGmBmAm, respectively. Among others, in an example that each layer includes n pixels, R1G1B1A1 may be $\{r_{11}g_{11}b_{11}a_{11}, r_{12}g_{12}b_{12}a_{12}, r_{13}g_{13}b_{13}a_{13}, \ldots, r_{1n}g_{1n}b_{1n}a_{1n}\}$, R2G2B2A2 may be $\{r_{21}g_{21}b_{21}a_{21}, r_{22}g_{22}b_{22}a_{22}, r_{23}g_{23}b_{23}a_{23}, \ldots, r_{2n}g_{2n}b_{2n}a_{2n}\}$, . . . RmGmBmAm may be $\{r_{m1}g_{m1}b_{m1}a_{m1}, r_{m2}g_{m2}b_{m2}a_{m2}, r_{m3}g_{m3}b_{m3}a_{m3}, \ldots, r_{mn}g_{mn}b_{mn}a_{mn}\}$. Superimposing the first image information of the pixels of the m layers comprises: superimposing the color information of the pixels in each layer according to the transparency information of the pixels and the ordering of each layer along the overlapping direction of the plurality of layers, so as to obtain the second image information of pixels in the overlaid layer image, that is, the RGB information of the pixels in the overlaid layer image. Taking the superposition of the first color information as an example, the superimposition process is performed by: firstly, superimposing the first color information of the pixels at the corresponding positions in the first and second layers, i.e. X2=R2*A2+R1*(1-A2); then superimposing the first color information of the pixels at the corresponding positions of the first, second, and third layers, i.e. X3=R3*A3+X2*(1−A3), . . . , and finally superimposing the first color information of the m layers, so as to obtain the first color information of the pixels in the overlaid layer image, i.e. R=Xm=Rm*Am+Xm−1*(1−Am). It is assumed that X1=R1*A1. Those skilled in the art can understand that in the above example, R1 may be $\{r_{11}, r_{12}, r_{13}, \ldots, r_{1n}\}$, R2 may be $\{r_{21}, r_{22}, r_{23}, \ldots, r_{2n}\}$, A1 may be $\{a_{11}, a_{12}, a_{13}, \ldots, a_{1n}\}$, and A2 may be $\{a_{21}, a_{22}, a_{23}, \ldots, a_{2n}\}$ and the like. Thus, X2=R2*A2+R1*(1−A2)=

$$\{r_{21}*a_{21}, r_{22}*a_{22}, r_{23}*a_{23}, \ldots, r_{2n}*a_{2n}\}+\{r_{11}*(1-a_{21}), r_{12}*(1-a_{22}), r_{13}*(1-a_{23}), \ldots, r_{1n}*(1-a_{2n})\}=$$

$$\{r_{21}*a_{21}+r_{11}*(1-a_{21}), r_{22}*a_{22}+r_{12}*(1-a_{22}), r_{23}*a_{23}+r_{13}*(1-a_{23}), \ldots, r_{2n}*a_{2n}+r_{1n}*(1-a_{2n})\}.$$

In this manner, the second color information G of the pixels in the overlaid layer image and the third color information B of the pixels in the overlaid layer image can be obtained by a similar calculation method. Therefore, it is possible to obtain the second image information of the pixels in the overlaid layer image.

According to an example, the first image information further includes position information and texture information of the layer. The step 102 in the above embodiment may further comprise:

superimposing the texture information of each layer according to the position information of each layer and the transparency information of the pixels in each layer, so as to obtain the second image information of pixels in the overlaid layer image.

Figure 6:
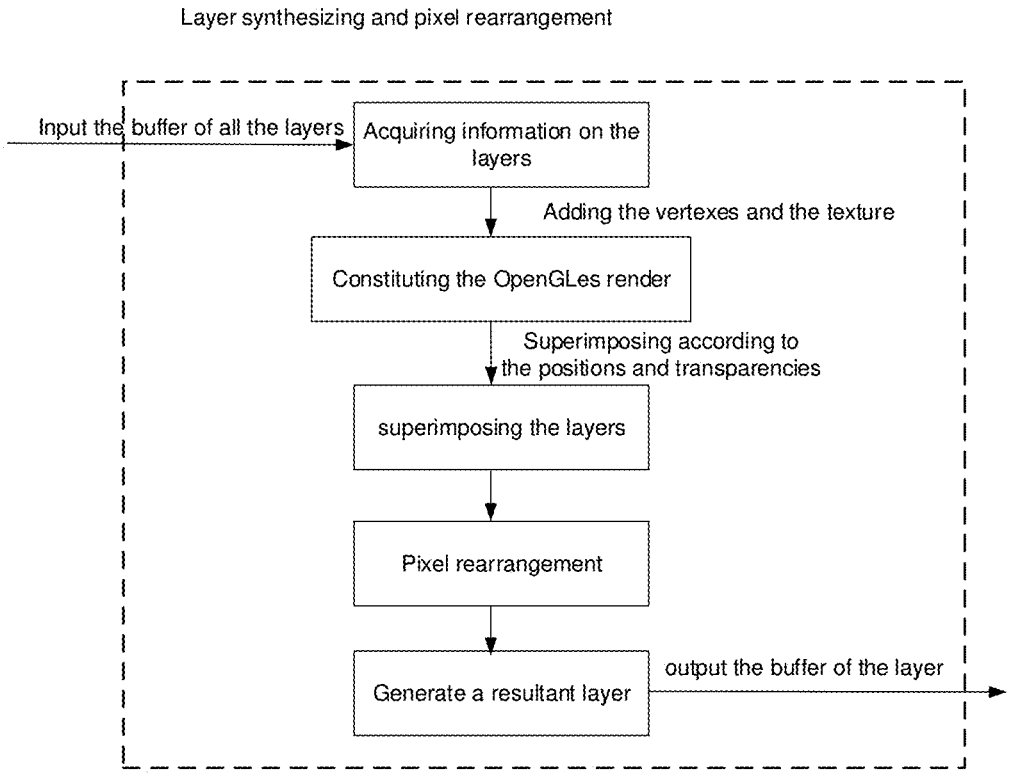
FIG. 6 shows a flow diagram illustrating a superposition and arrangement according to an embodiment of the present disclosure.

For example, referring to FIG. 6, after receiving the first image information of the pixels in each layer, "surfaceflinger" parses the position information and the texture information therein, bonds the parsed information to a newly created OpenGLes rendering program 1, and superimposes the texture information of each layer in rendering program 1 according to the position information of each layer and the transparency information of the pixels in each layer, so as to obtain the second image information "fbuffer1" of pixels in the overlaid layer image. In practical applications, "fbuffer1" can be inputted as a texture in a rendering program 2, and re-rendered to rearrange its pixels. The specific process is described in step 103, thereby generating and outputting "fbuffer2" as the third image information.

It should be noted that in OpenGLes drawing, all graphics consist of triangles. Therefore, the position information can be vertex information. The position of the triangle can be determined by three vertex coordinates (vertex information). In addition, the content of each layer may be the texture information, and coloring the triangle in the OpenGLes drawing may comprise determining the value of each pixel in the layer according to the texture information.

Figure 8:
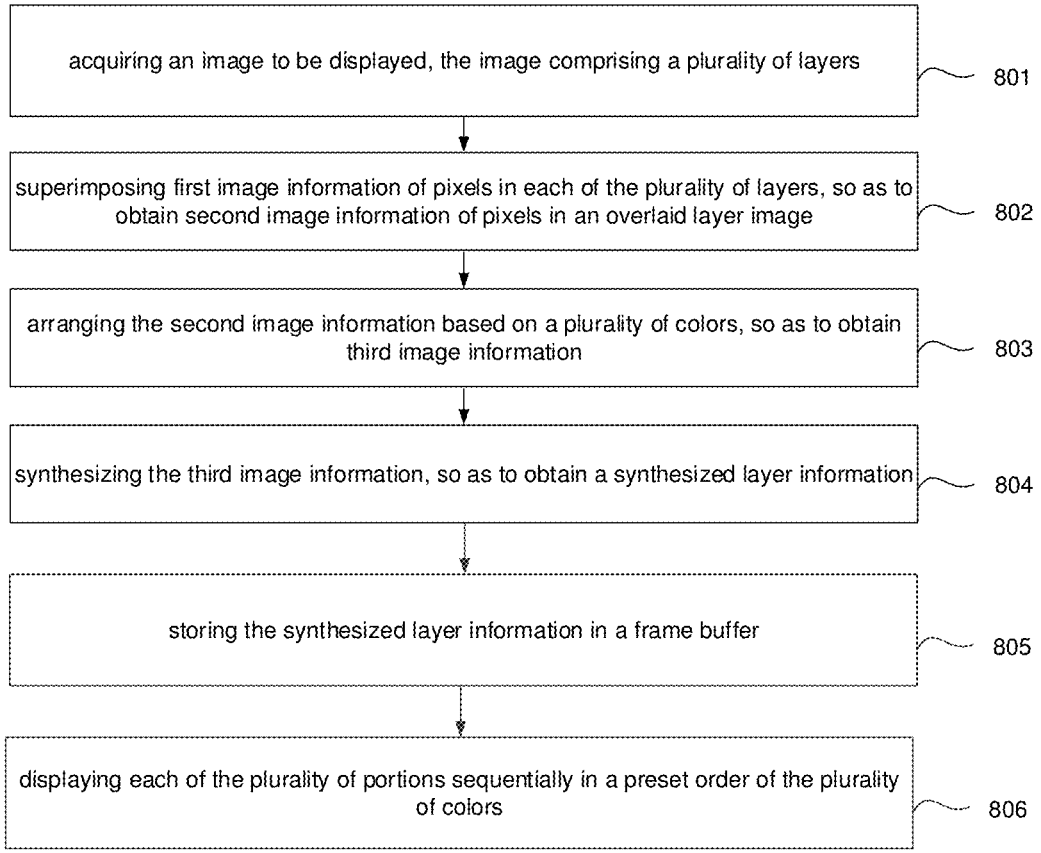
FIG. 8 shows a flow chart illustrating steps of another display method according to an embodiment of the present disclosure.

Another embodiment of the present disclosure further provides a display method that can be applied to an electronic device. As shown in FIG. 8, the display method may include the following steps.

At step 801, an image to be displayed is acquired, the image including a plurality of layers.

At step 802, the first image information of pixels in each of the plurality of layers is superimposed, so as to obtain second image information of pixels in an overlaid layer image, wherein the first image information comprises a plurality of color information and transparency information, and the second image information comprises a superposition result of the plurality of color information.

In step 803, the second image information is arranged based on a plurality of colors, so as to obtain third image information comprising a plurality of portions, each of the plurality of portions having the same color.

Steps 801 to 803 in this embodiment are the same as or similar to the steps 101 to 103 in the previous embodiment, and will not be described herein. Following description is mainly focused on the differences from the previous embodiment.

At step 804, the third image information is synthesized to obtain synthesized layer information.

At step 805, the synthesized layer information is stored in a frame buffer.

If the synthesized layer information is synthesized by using MDP, Surfaceflinger will send the third image information to HWComposer (hardware synthesizer interface). At this time, HWComposer will check the MDP device, send the third image information to the MDP for synthesis in response to an acknowledgement, so as to obtain the synthesized layer information, and store the synthesized layer information in the frame buffer (framebuffer), for being read and outputted by the driving IC of the field sequential display for displaying.

If the synthesized layer information is synthesized by using the GPU, the third image information will be transmitted to the GPU in the form of texture. After being rendered by the GUP, the synthesized layer information will be transmitted to the frame buffer (framebuffer), so as to be read and outputted by the driving IC of the field sequential display for displaying.

Among others, HWComposer is an interface class which is a standard designed to be compatible with various types of MDP hardware. Opengles is also a graphical interface designed to be compatible with various types of GPUs.

Next, in step 806, each portion having the same color among the synthesized layer information is read from the frame buffer and then displayed sequentially in the preset order of the plurality of colors.

The step 806 in this embodiment is the same as or similar to the previous embodiment, and thus will not be described in detail.

Figure 9:
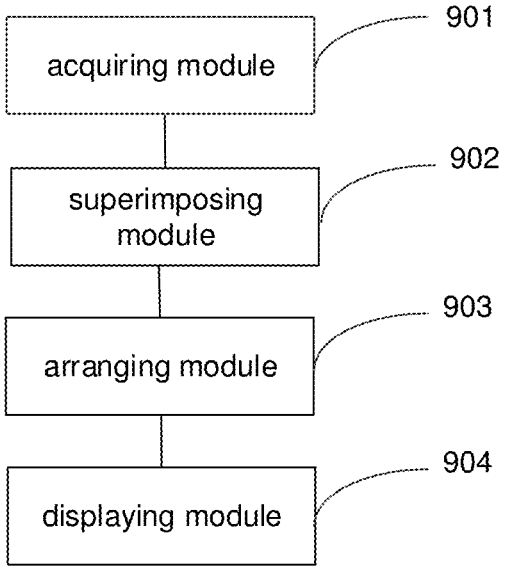
FIG. 9 shows a structural diagram illustrating a display device according to an embodiment of the present disclosure.

FIG. 9 shows a structural diagram illustrating a display device according to an embodiment of the present disclosure. The display device can be applied to electronic devices. Referring to FIG. 9, the display device may include an acquiring module 901, a superimposing module 902, a superimposing module 903 and a displaying module 904. The acquiring module 901 is configured to acquire an image to be displayed, the image comprising a plurality of layers. The superimposing module 902 is configured to superimpose first image information of pixels in each of the plurality of layers, so as to obtain second image information of pixels in an overlaid layer image, wherein the first image information comprises a plurality of color information and transparency information, and the second image information comprises a superposition result of the plurality of color information. The arranging module 903 is configured to arrange the second image information based on a plurality of colors, so as to obtain third image information comprising a plurality of portions, each of the plurality of portions having the same color. The displaying module 904 is configured to display each of the plurality of portions sequentially in the preset order of the plurality of colors.

Figure 10:
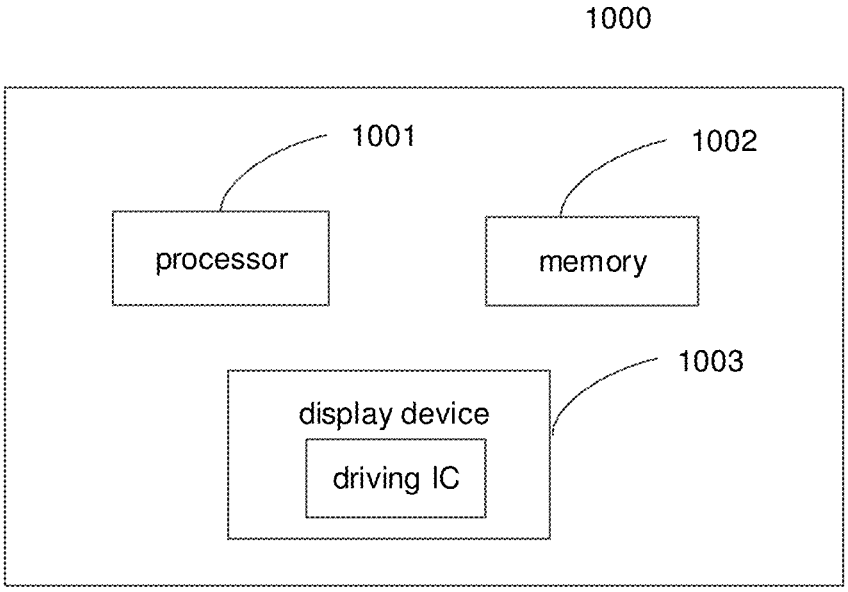
FIG. 10 shows another structural diagram illustrating the display device according to an embodiment of the present disclosure.

Embodiments of the present disclosure also provide a display device. FIG. 10 shows another structural diagram illustrating the display device according to an embodiment of the present disclosure. As shown in FIG. 10, the display device 1000 can comprise: one or more processors 1001; and a memory 1002 configured to store one or more programs. The one or more processors 1001 are configured to execute the one or more programs, so as to implement the method in accordance with the above embodiments of the disclosure.

As shown in FIG. 10, the display device 1000 may further include a displaying unit 1003. The one or more processors 1001 are further configured to: synthesize the third image information, so as to obtain a synthesized layer information; store the synthesized layer information in a frame buffer; and read the portion having the same color among the synthesized layer information from the frame buffer sequentially in the preset order of the plurality of colors, and send the read portion to the displaying unit 1003. The displaying unit 1003 is configured to receive and display the portion having the same color.

The one or more processors 1001 are further configured to synthesize the third image information by using a Mobile Display Processor MDP or a Graph Process Unit GPU, so as to obtain the synthesized layer information. The displaying unit 1003 may include a driving IC, configured to parse each portion having the same color among the synthesized layer information sequentially for displaying.

With respect to the devices in the above embodiments, the specific manner in which the respective modules operates and the advantageous effects of the respective modules have been described in detail in the embodiments relating to the method, and will not be explained in detail herein.

Another embodiment of the present application further provides an electronic device, including the display device according to any of the above embodiments.

It should be noted that the electronic device in this embodiment may be any product or component having a display function, such as a display panel, an electronic paper, a mobile phone, a tablet computer, a television, a notebook computer, a digital photo frame, a navigator, and the like.

Another embodiment of the present application further provides a computer readable storage medium having computer programs stored thereon which, when executed by a processor, implement the method in accordance with any of the above embodiments of the present disclosure.

The embodiments of the present disclosure provide a display method, a display device, an electronic device, and a computer readable storage medium, which may obtain the third image information comprising a plurality of portions by superimposing first image information of pixels in the plurality of layers and arranging the second image information in the overlaid layer image, and display each of the plurality of portions sequentially in a preset order of the plurality of colors, thereby performing the field sequential display correctly, reducing the cost and the power consumption, and increasing the battery life. Further, since the field sequence display does not need to set sub-pixels, the aperture ratio can be increased by 33% theoretically, and a higher PPI can be achieved based on the existing process, achieving a better display effect.

Various embodiments in the present description are described in a progressive manner, and each embodiment is described by focusing on the difference from other embodiments, and the same or similar components or steps among the various embodiments can be referred to each other.

Finally, it should also be noted that in this context, relational terms such as "first" and "second" are used merely to distinguish one entity or operation from another entity or operation, and do not necessarily require or imply any relationship or order among these entities or operations. Furthermore, the terms of "comprises" or "comprising" or "include" or any other variations are intended to encompass a non-exclusive inclusion, such that a process, method, product, or device comprising a series of elements is not only intended to include the listed elements, but also to include other elements that are not listed, or elements that are inherent to such a process, method, product, or device. An element defined by the phrase "comprising a . . . " does not mean that there is only one such element comprised, i.e., the process, method, product, or device including the element does not exclude the presence of additional equivalent elements therein, unless otherwise stated.

The display method, the display device, the electronic device and the computer readable storage medium according to the embodiments of the present disclosure are described in detail. The principles and implementations of the embodiments of the present disclosure are described with reference to specific examples. The description of the examples is only for the purpose of facilitating in understanding the method and the idea of the embodiments of the present disclosure. All changes or substitutions that are easily conceived by those skilled in the art in view of the embodiments of the present disclosure are intended to be included within the scope of the present disclosure. Therefore, the description herein should not be considered as a limit to the embodiments of the disclosure.

We claim:

1. A method of displaying an image, comprising:

acquiring an image to be displayed, the image comprising a plurality of layers;

superimposing first image information of pixels in each of the plurality of layers, so as to obtain second image information of pixels in an overlaid layer image, wherein the first image information comprises a plurality of color information and transparency information, and the second image information comprises a superposition result of the plurality of color information;

arranging the second image information based on a plurality of colors, so as to obtain third image information comprising a plurality of portions, each portion of the plurality of portions having a same color; and displaying each portion of the plurality of portions sequentially in a preset order of the plurality of colors;

wherein the plurality of colors comprises a Red(R) color, a Green(G) color, and a Blue(B) color, and wherein arranging the second image information based on the plurality of colors so as to obtain the third image information comprises:

determining a position of each element of the second image information in the third image information, wherein the overlaid layer image comprises n pixels, and each of the n pixels comprises three sub-pixels, the $x^{th}$ R sub-pixel Rx being positioned in the $((x-1)\%3+1)^{th}$ sub-pixel of the $(\text{floor}((x-1)/3)+1)^{th}$ pixel in the third image information, the $x^{th}$ G sub-pixel Gx being positioned in the $((x-1)\%3+1)^{th}$ sub-pixel of the $(n/3+\text{floor}((x-1)/3)+1)^{th}$ pixel in the third image information, and the $x^{th}$ B sub-pixel Bx being positioned in the $((x-1)\%3+1)^{th}$ sub-pixel of the $(2n/3+\text{floor}((x-1)/3)+1)^{th}$ pixel in the third image information, where "%" is a modulus operator, "floor" is a down rounding operator, n is an integer greater than 3, and x=1 . . . n.

2. The method of claim 1, wherein each of the plurality of layers is arranged in an overlaid manner, and wherein superimposing the first image information of the pixels in each of the plurality of layers, so as to obtain the second image information of pixels in an overlaid layer image comprises:

superimposing the color information of the pixels in each layer according to the transparency information of the pixels and an ordering of each layer along an overlapping direction of the plurality of layers, so as to obtain the second image information of pixels in the overlaid layer image.

3. The method of claim 1, wherein the first image information further comprises position information and texture information of the layer, and wherein superimposing the first image information of the pixels in each of the plurality of layers, so as to obtain the second image information of pixels in an overlaid layer image comprises:

superimposing the texture information of each layer according to the position information of each layer and the transparency information of the pixels in each layer, so as to obtain the second image information of pixels in the overlaid layer image.

4. The method of claim 1, further comprising, prior to displaying each portion of the plurality of portions sequentially:

synthesizing the third image information, so as to obtain a synthesized layer information; and storing the synthesized layer information in a frame buffer, wherein displaying each portion of the plurality of portions sequentially further comprises:

reading and displaying each portion having the same color among the synthesized layer information from the frame buffer sequentially in the preset order of the plurality of colors.

5. The method of claim 4, wherein synthesizing the third image information so as to obtain the synthesized layer information comprises:

synthesizing the third image information by using a Mobile Display Processor MDP or a Graphics Processing Unit GPU, so as to obtain the synthesized layer information.

6. The method of claim 4, wherein displaying each portion of the plurality of portions sequentially further comprises:

parsing each portion having the same color among the synthesized layer information sequentially, and outputting a parsed portion for displaying.

7. A display device, comprising:

one or more processors; and a memory, configured to store one or more programs, wherein the one or more processors are configured to execute the one or more programs, so as to implement the method of claim 1.

8. The display device of claim 7, further comprising a displaying unit, and wherein the one or more processors are further configured to:

synthesize the third image information, so as to obtain a synthesized layer information;

store the synthesized layer information in a frame buffer; and read the portion having the same color among the synthesized layer information from the frame buffer sequentially in the preset order of the plurality of colors, and send the read portion to the displaying unit, wherein the displaying unit is configured to receive and display the portion having the same color.

9. The display device of claim 8, wherein the one or more processors are further configured to:

synthesize the third image information by using a Mobile Display Processor MDP or a Graphics Processing Unit GPU, so as to obtain the synthesized layer information.

10. The display device of claim 8, wherein the displaying unit further comprises: a driving IC, configured to parse each portion having the same color among the synthesized layer information sequentially for displaying.

11. An electronic device comprising the display device of claim 7.

12. A non-transitory computer readable storage medium having instructions stored thereon which, when executed by a processor, implement the method of claim 1.

* * * * *